US010597829B2

(12) United States Patent
Sninchak

(10) Patent No.: US 10,597,829 B2
(45) Date of Patent: Mar. 24, 2020

(54) HIGHWAY INTERCHANGE

(71) Applicant: Joseph M. Sninchak, Arvada, CO (US)

(72) Inventor: Joseph M. Sninchak, Arvada, CO (US)

( * ) Notice: Subject to any disclaimer, the term of this patent is extended or adjusted under 35 U.S.C. 154(b) by 0 days.

(21) Appl. No.: 16/191,434

(22) Filed: Nov. 14, 2018

(65) Prior Publication Data

US 2019/0145053 A1 May 16, 2019

Related U.S. Application Data

(60) Provisional application No. 62/585,820, filed on Nov. 14, 2017.

(51) Int. Cl.
*E01C 1/04* (2006.01)

(52) U.S. Cl.
CPC ..... *E01C 1/04* (2013.01)

(58) Field of Classification Search
CPC ..... E01C 1/04
USPC ..... 404/1
See application file for complete search history.

(56) References Cited

U.S. PATENT DOCUMENTS 1,689,161 A * 10/1928 Skultin ..... E01C 1/04 104/124
3,238,854 A * 3/1966 Okubo ..... E01C 1/04 404/1
3,394,638 A * 7/1968 Burrell ..... E01C 1/04 404/1
6,685,386 B1 * 2/2004 Lee ..... E01C 1/04 404/1
2004/0184879 A1 * 9/2004 Winkler ..... E01C 1/04 404/1
2007/0237576 A1 * 10/2007 Peng ..... E01C 1/04 404/1
2009/0010711 A1 * 1/2009 Yin ..... E01C 1/04 404/1
2014/0205376 A1 * 7/2014 Derenoncourt ..... E01C 1/04 404/1
2015/0117947 A1 * 4/2015 Zhou ..... E01C 1/04 404/1
2015/0218760 A1 * 8/2015 Carney, Jr. ..... E01C 1/04 404/1

FOREIGN PATENT DOCUMENTS

FR 701666 A * 3/1931 ..... E01C 1/04
FR 940788 A * 12/1948 ..... E01C 1/04
FR 1243584 A * 10/1960 ..... E01C 1/04

* cited by examiner

*Primary Examiner* — Thomas B Will
*Assistant Examiner* — Katherine J Chu

(57) ABSTRACT

A highway interchange facilitates the intersection of two or more highways or other roadways. A plurality of travel paths forming a major thoroughfare and a minor thoroughfare are connected together through a plurality of exits. For each travel path, a right turn exit and a left turn exit are provided, giving travelers the option of either continuing straight or transitioning from one thoroughfare to the other in either direction.

1 Claim, 2 Drawing Sheets

HIGHWAY INTERCHANGE

The current application claims a priority to the U.S. Provisional Patent application Ser. No. 62/585,820 filed on Nov. 14, 2017.

FIELD OF THE INVENTION

The present invention relates generally to roadways. More particularly, the present invention relates to a highway interchange.

BACKGROUND OF THE INVENTION

Driving is supposed to be a faster way to get a person from point A to point B through long distances. Traveling on interstates or highways can be a great way to cut time off of a drive and get to a destination faster. The problem is traffic flow and high traffic hours that cause commutes or simply traveling to take much longer. Another problem while being on a highway is the mistake drivers make when they take a wrong exit or turn. This can cause an unfortunate and frustrating waste of time. The present invention seeks to address these issues and present a highway interchange that smoothly facilitates traffic interchange between two highways or other roadways.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention

DETAIL DESCRIPTIONS OF THE INVENTION

Figure 1:
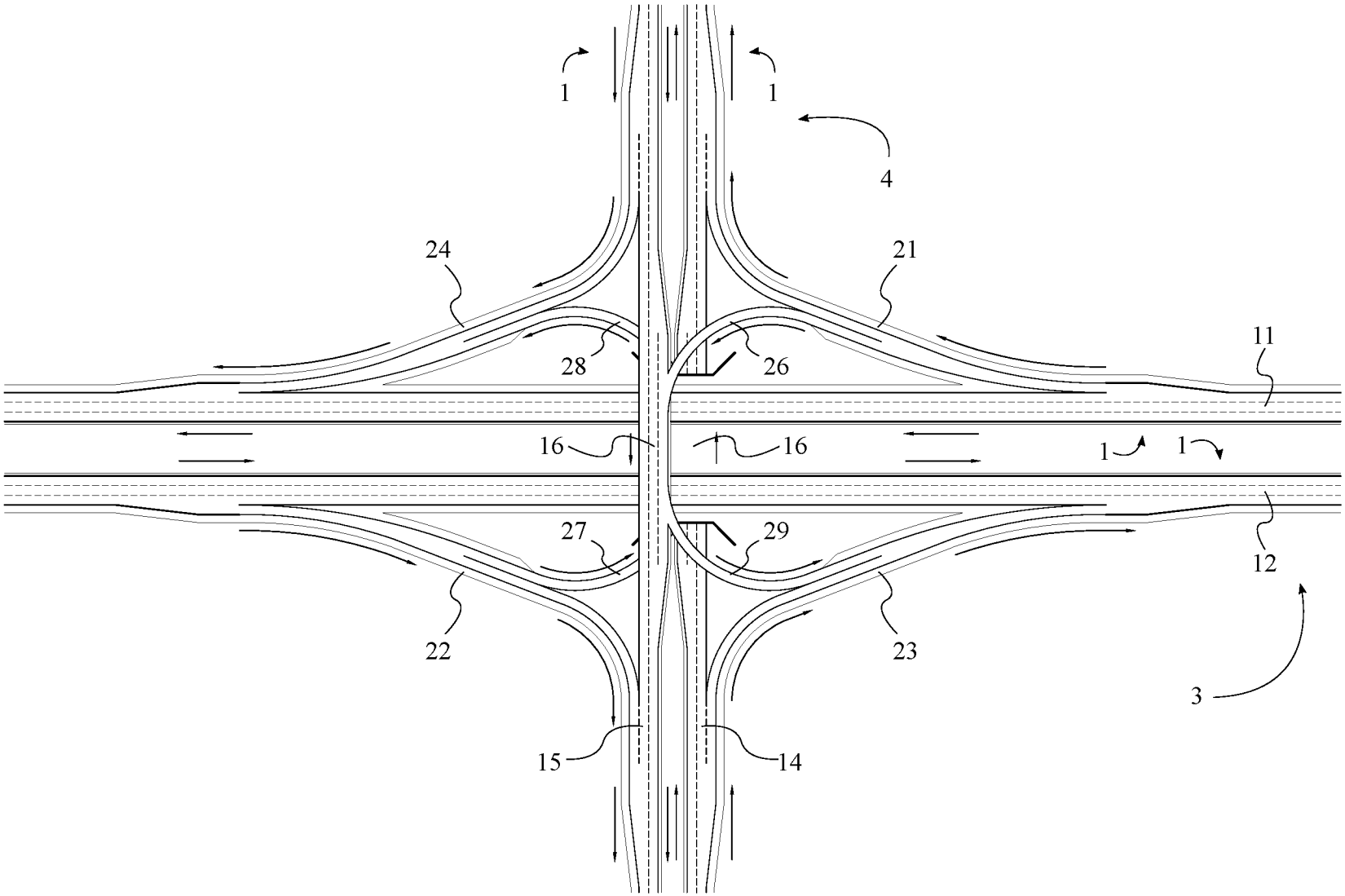
FIG. 1 is a diagram of the present invention.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment". "some embodiments", or "alternative embodiments" should be considered to be illustrating aspects of the present invention that may potentially vary in some instances, and should not be considered to be limiting to the scope of the present invention as a whole.

The present invention is an arrangement for a highway interchange for two intersecting highways or other types of roadways in which a traveler in a vehicle may easily change course or stay going straight to travel either direction on either roadway. The present invention may be referred to in some embodiments as an "Over and Under Cloverleaf." The present invention is intended to intersect two roadways, though it is contemplated that in some embodiments more than two roadways may be intersected in a similar manner. The present invention allows, for instance, interstate to minor and major thoroughfares or interstate to interstate interchanges.

The Over & Under Cloverleaf is a compact interchange that can also be expanded as the building envelope allows it. The interchange allows for interstate to minor and major thoroughfares or interstate to interstate interchanges.

The major interstate travels straight through as usual and the other thoroughfare travels beneath and over the major interstate allowing entering and exiting both roadways by merging into traffic. With this type of interchange, the use of traffic lights is not required.

As a vehicle travels the main interstate and merges off the highway onto the off ramp, they have two directional choices: left or right, relative to the current position of the vehicle. Going right is the same as usual merging into traffic going to the right direction. Going left means traveling either over or under the interstate and merging into traffic depending on the configuration and the direction traveled on the interchange.

As traffic travels the minor thoroughfare and enters the interchange, drivers have three choices going left, right, or straight through the interchange. Going right is the same as usual merging into traffic that is traveling down the interstate in the right direction.

Going straight allows the driver to travel through the interchange. Going left allows traffic to go over or under the minor thoroughfare to merge onto the interstate, depending on the configuration of the interchange. The interchange doesn't require the lower road be tunneled under the interstate, all roads can be above ground if so desired and topography allows.

Referring to FIG. 1, in general, the present invention comprises a plurality of travel paths 1 comprising a first major travel path 11, a second major travel path 12, a first minor travel path 14, and a second minor travel path 15. The present invention further comprises a plurality of exits. The first major travel path 11 and the second major travel path 12 are oriented parallel to and directionally opposite each other, wherein the first major travel path 11 and the second major travel path 12 form a major thoroughfare 3. For example, the major thoroughfare 3 may be understood to be oriented in a north-south orientation, with the first major travel path 11 traveling north and the second major travel path 12 traveling south. Similarly, the first minor travel path 14 and the second minor travel path 15 are oriented parallel to and directionally opposite each other, wherein the first minor travel path 14 and the second minor travel path 15 form a minor thoroughfare 4. For example, the minor thoroughfare 4 may be oriented in an east-west direction, with the first minor travel path 14 traveling east and the second minor travel path 15 traveling west. The specific type of roadway is not of particular importance, and the major thoroughfare 3 and minor thoroughfare 4 should not be considered to be limited to highway-type roadways. Furthermore, the major and minor modifiers are used herein primarily to differentiate the two thoroughfares in question, and should not be considered limiting as to the size, capacity, or general configuration of the two thoroughfares.

The plurality of travel paths 1 are configured to intersect with each other, and the plurality of travel paths 1 are connected to each other through the plurality of exits. In the preferred embodiment of the present invention, the plurality of travel paths 1 are connected together through the plurality of exits such that a vehicle traveling in either direction on either the major thoroughfare 3 or the minor thoroughfare 4 may proceed in any direction on either thoroughfare.

In the preferred embodiment of the present invention, the plurality of exits comprises a first right turn exit 21, a second right turn exit 22, a third right turn exit 23, and a fourth right turn exit 24. The first right turn exit 21 traverses from the first major travel path 11 to the first minor travel path 14; the second right turn exit 22 traverses from the second major travel path 12 to the second minor travel path 15; the third right turn exit 23 traverses from the first minor travel path 14 to the second major travel path 12, and the fourth right turn exit 24 traverses from the second minor travel path 15 to the first major travel path 11. Thus, a vehicle traveling along any one of the plurality of travel paths 1 has the option to take a right hand turn in order to be transferred from one thoroughfare to the other by approximately 90 degrees, though it is acknowledged that the major thoroughfare 3 and the minor thoroughfare 4 may not be oriented substantially perpendicular to each other, though for the purposes of the current disclosure that may be generally assumed.

Furthermore, in the preferred embodiment, the plurality of exits further comprises a first left turn exit 26, a second left turn exit 27, a third left turn exit 28, and a fourth left turn exit 29. The first left turn exit 26 traverses from the first major travel path 11 to the second minor travel path 15; the second left turn exit 27 traverses from the second major travel path 12 to the first minor travel path 14; the third left turn exit 28 traverses from the first minor travel path 14 to the first major travel path 11; and the fourth left turn exit 29 traverses from the second minor travel path 15 to the second major travel path 12. Thus, similarly to the previously described right turn exits, the present invention provides travelers with a left turn exit for each of the plurality of travel paths 1. Thus, each of the plurality of travel paths 1 is provided with both a right turn exit and a left turn exit, enabling the traveler to proceed onto either direction of the opposing thoroughfare.

Figure 2:
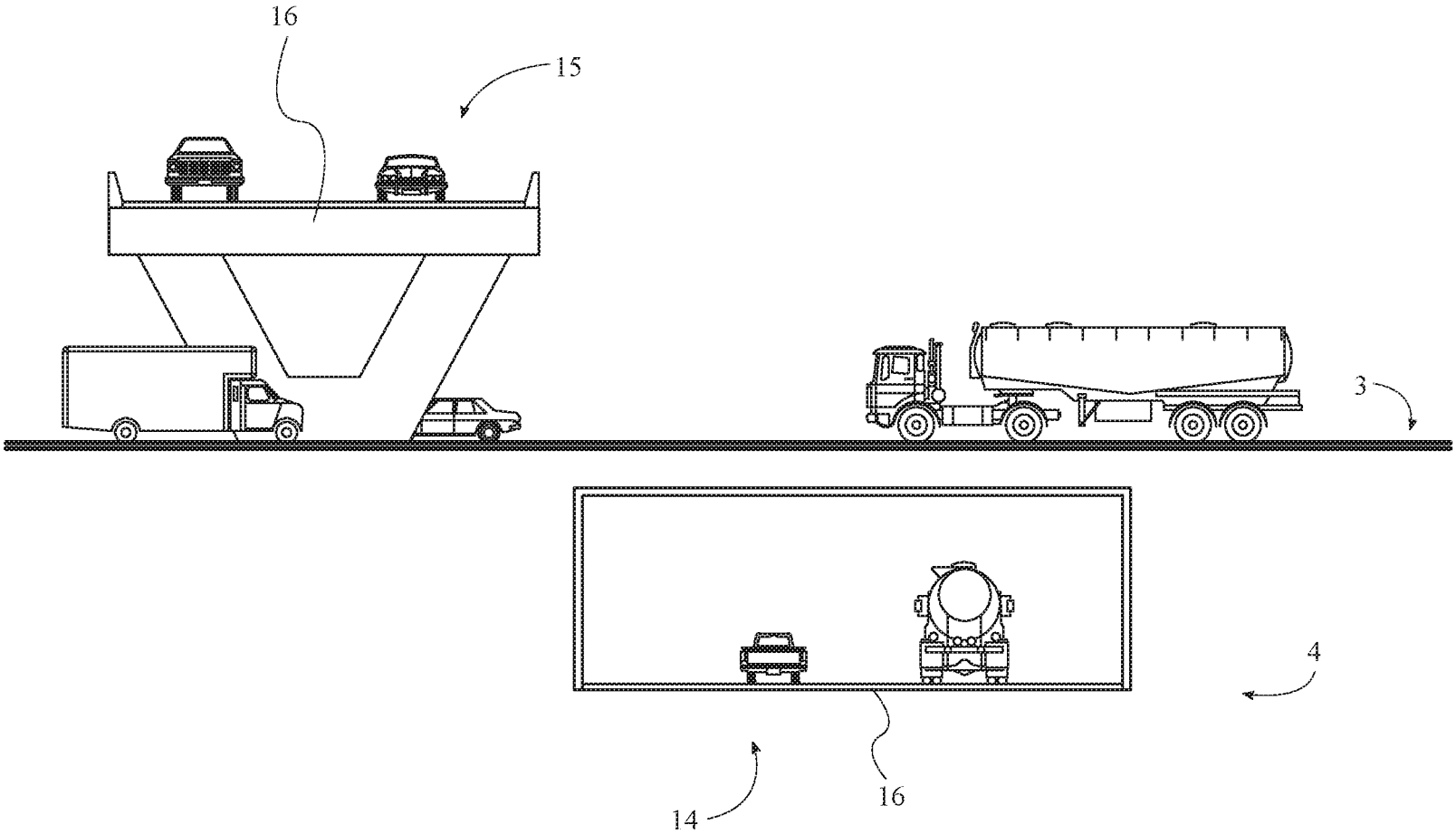
FIG. 2 is a cross-sectional illustration of the major and minor thoroughfares intersecting each other, with the minor thoroughfare traversing over and under the major thoroughfare.

Since the major thoroughfare 3 and the minor thoroughfare 4 cross paths, it is necessary for some portions of at least one of the thoroughfares to be disposed above the other thoroughfare. In the preferred embodiment, as can be seen in FIG. 2, the first minor travel path 14 traverses over the major thoroughfare 3, while the second minor travel path 15 traverses under the major thoroughfare 3. In other embodiments, other configurations may be utilized, such as, but not limited to, the reverse of the aforementioned arrangement.

More particularly, in the preferred embodiment, the first minor travel path 14 and the second minor travel path 15 each comprise a medial intersection portion 16. In some embodiment, the medial intersection portion 16 of the first minor travel path 14 is positioned beneath the major thoroughfare 3, while the medial intersection portion 16 of the second minor travel path 15 is positioned above the major thoroughfare 3. In other embodiments, the aforementioned arrangement may be reversed, or another arrangement may be utilized.

In the preferred embodiment, the first left turn exit 26 traverses from the first major travel path 11 to the medial intersection portion 16 of the second minor travel path 15; the second left turn exit 27 traverses from the second major travel path 12 to the medial intersection portion 16 of the first minor travel path 14; the third left turn exit 28 traverses from the medial intersection portion 16 of the first minor travel path 14 to the first major travel path 11; and the fourth left turn exit 29 traverses from the medial intersection portion 16 of the second minor travel path 15 to the second major travel path 12.

The functionality of the present invention follows from the previous disclosure, in that the present invention facilitates the intersection of two or more roadways, each with opposing travel paths. On any given travel path approaching the interchange, a vehicle has three options: continue on their original travel path, or make a left or right exit to transition to the opposing roadway from the roadway they came from. For example, a vehicle traveling north on the first major travel path 11 may continue through the interchange on the first major travel path 11, take the first left turn exit 26 to proceed west on the first minor travel path 14, or take the first right turn exit 21 to proceed east on the second minor travel path 15. In another example, a vehicle traveling east on the second minor travel path 15 may continue straight, take the fourth right turn exit 24 to proceed south on the second major travel path 12, or take the fourth left turn exit 29 to proceed north on the first major travel path 11.

Although the invention has been explained in relation to its preferred embodiment, it is to be understood that many other possible modifications and variations can be made without departing from the spirit and scope of the invention as hereinafter claimed.

What is claimed is:

1. A highway interchange comprising:

a plurality of travel paths;

the plurality of travel paths comprising a first major travel path, a second major travel path, a first minor travel path and a second minor travel path;

a plurality of exits;

the first major travel path and the second major travel path being oriented parallel to and directionally opposite each other, wherein the first major travel path and the second major travel path form a major thoroughfare;

the first minor travel path and the second minor travel path being oriented parallel to and directionally opposite each other, wherein the first minor travel path and the second minor travel path form a minor thoroughfare, and wherein the plurality of travel paths are configured to intersect with each other;

the plurality of travel paths being connected to each other through the plurality of exits;

the first minor travel path traversing under the major thoroughfare;

the second minor travel path traversing over the major thoroughfare;

the plurality of exits comprising a first right turn exit, a second right turn exit, a third right turn exit and a fourth right turn exit;

the first right turn exit traversing from the first major travel path to the first minor travel path;

the second right turn exit traversing from the second major travel path to the second minor travel path;

the third right turn exit traversing from the first minor travel path to the second major travel path;

the fourth right turn exit traversing from the second minor travel path to the first major travel path;

the plurality of exits comprising a first left turn exit, a second left turn exit, a third left turn exit and a fourth left turn exit;

the first left turn exit traversing from the first major travel path to the second minor travel path;

the second left turn exit traversing from the second major travel path to the first minor travel path;

the third left turn exit traversing from the first minor travel path to the first major travel path;

the fourth left turn exit traversing from the second minor travel path to the second major travel path;

the first minor travel path and the second minor travel path each comprising a medial intersection portion;

the medial intersection portion of the first minor travel path being positioned beneath the major thoroughfare, wherein the medial intersection portion of the first minor travel path is positioned beneath the first major travel path and the second major travel path;

the medial intersection portion of the second minor travel path being positioned above the major thoroughfare, wherein the medial intersection portion of the second minor travel path is positioned above the first major travel path and the second major travel path;

the first left turn exit traversing from the first major travel path to the medial intersection portion of the second minor travel path;

the second left turn exit traversing from the second major travel path to the medial intersection portion of the first minor travel path;

the third left turn exit traversing from the medial intersection portion of the first minor travel path to the first major travel path; and the fourth left turn exit traversing from the medial intersection portion of the second minor travel path to the second major travel path.

* * * * *